US007758212B2

(12) United States Patent
Jan et al.

(10) Patent No.: US 7,758,212 B2
(45) Date of Patent: Jul. 20, 2010

(54) LIGHT EMITTING DIODE DEVICE INCLUDING INCLINED REFLECTING PLATES

(75) Inventors: Shun-Yuan Jan, Taipei Hsien (TW); Fang-Xiang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 90 days.

(21) Appl. No.: 12/239,837

(22) Filed: Sep. 29, 2008

(65) Prior Publication Data

US 2009/0294786 A1 Dec. 3, 2009

(30) Foreign Application Priority Data

May 28, 2008 (CN) ..... 2008 1 0067518

(51) Int. Cl.
*F21S 4/00* (2006.01)
*F21V 7/04* (2006.01)
*F21V 11/02* (2006.01)

(52) U.S. Cl. ..... 362/249.02; 362/342; 362/241; 362/236; 257/88; 257/98

(58) Field of Classification Search ..... 362/97.3, 362/145, 227, 236, 240, 241, 249.02, 341, 362/342; 257/88, 98
See application file for complete search history.

(56) References Cited

U.S. PATENT DOCUMENTS

| | | | | |
|---|---|---|---|---|
| 693,088 | A * | 2/1902 | Wadsworth | 359/596 |
| 5,924,785 | A * | 7/1999 | Zhang et al. | 362/241 |
| 6,964,489 | B2 * | 11/2005 | Blume et al. | 362/27 |
| 7,465,071 | B2 * | 12/2008 | Beukert et al. | 362/297 |
| 2006/0291079 | A1 | 12/2006 | Beukert et al. | |

FOREIGN PATENT DOCUMENTS

| | | | |
|---|---|---|---|
| CN | 101069122 | A | 11/2007 |

* cited by examiner

*Primary Examiner*—Ismael Negron
(74) *Attorney, Agent, or Firm*—Frank R. Niranjan

(57) ABSTRACT

A light emitting diode device includes a substrate, a plurality of light emitting diode chips mounted on the substrate and arranged in a plurality of lines and a frame located on the substrate. The frame includes a plurality of first plates each extending along a first direction of the substrate, a plurality of second plates each extending along a second direction of the substrate and a plurality of reflecting plates. The first plates and the second plates cooperatively form a plurality of receiving rooms for receiving the light emitting diode chips therein. Each reflecting plate is located above a corresponding line of light emitting diode chips and inclined with respect to the substrate.

15 Claims, 4 Drawing Sheets

LIGHT EMITTING DIODE DEVICE INCLUDING INCLINED REFLECTING PLATES

BACKGROUND

1. Field of the Invention

The present invention relates to light emitting diode devices, and more specifically to a light emitting diode device for outdoor luminaires.

2. Description of Related Art

Light emitting diodes (LEDs) are commonly used as light sources in illuminating devices such as traffic lights, street lamps, billboards, displays and so on. The LED has several advantages such as high brightness, long lifespan and low-power consumption over incandescent and fluorescent lamps.

Conventional illuminating devices incorporating LEDs generally generate diffusion-type light field. The diffusion-type light field is substantially circular. In other words, a part of the light field along an x-direction is substantially the same as a part of the light field along a y-direction. However, this type of light field of the LED illuminating device is not always required in our daily life, such as in a street lamp, which has a strip-type light field requirement. If the diffusion-type light field is applied in the street lamp, part of light will not be used, which decreases utilization rate of the light emitted from the LEDs.

For the foregoing reasons, it is desirable to provide a LED illuminating device which can overcome the described limitations.

SUMMARY

A light emitting diode device is provided. According to an exemplary embodiment, the light emitting diode device includes a substrate, a plurality of light emitting diode chips mounted on the substrate and arranged in a plurality of lines and a frame located on the substrate. The frame includes a plurality of first plates each extending along a first direction of the substrate, a plurality of second plates each extending along a second direction of the substrate and a plurality of reflecting plates. The first plates and the second plates cooperatively form a plurality of receiving rooms for receiving the light emitting diode chips therein. Each reflecting plate is located above a corresponding line of light emitting diode chips and inclined with respect to the substrate.

Other advantages and novel features of the present invention will become more apparent from the following detailed description of embodiment when taken in conjunction with the accompanying drawings.

DETAILED DESCRIPTION OF THE EMBODIMENTS

Reference will now be made to the drawings to describe the various present embodiments in detail.

Figure 1:
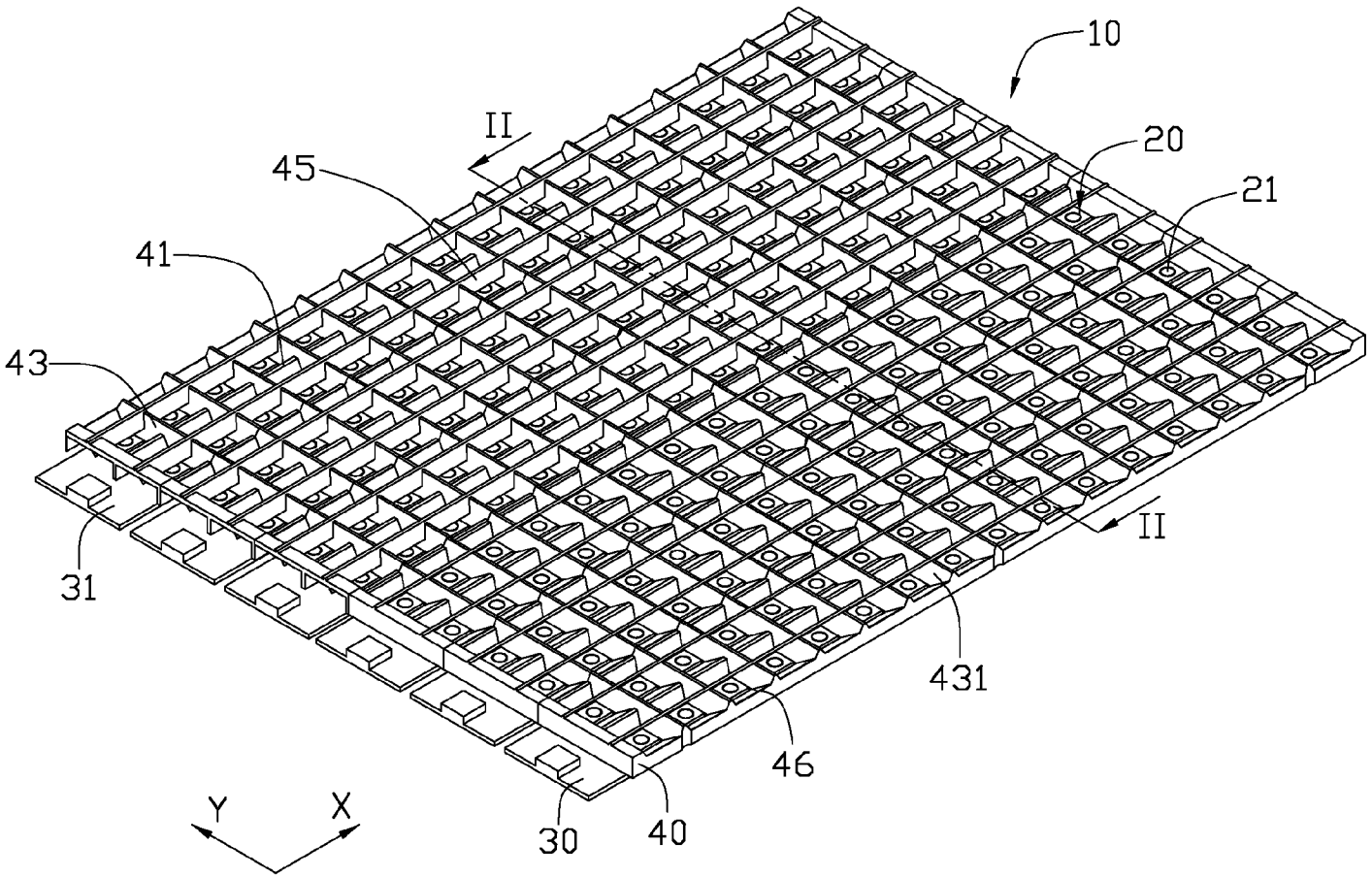
FIG. 1 is a schematic, isometric view of a light emitting diode device in accordance with an exemplary embodiment of the present invention.
Figure 2:
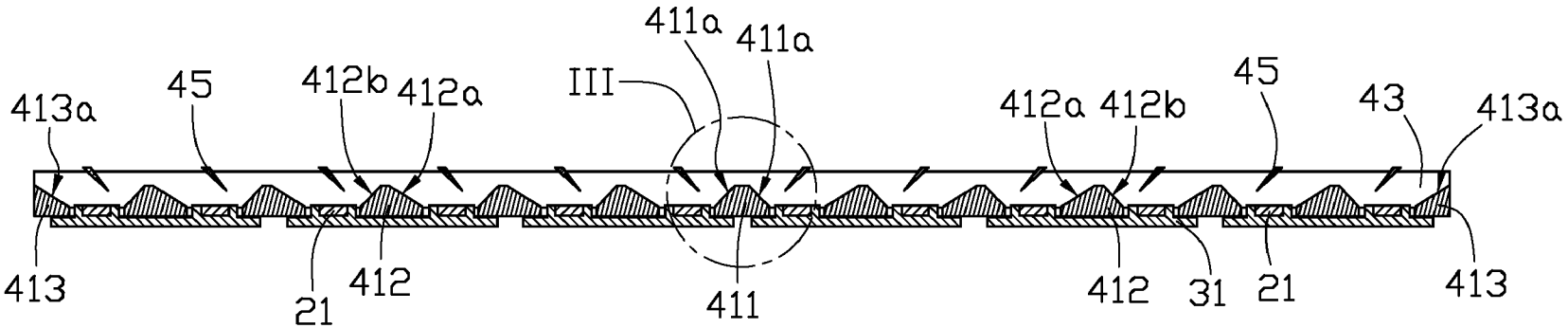
FIG. 2 is a cross-section of the light emitting diode device of FIG. 1, along line II-II thereof.

Referring to FIG. 1 and FIG. 2, a light emitting diode (LED) device 10 includes a substrate 30, a LED array 20 and a frame 40.

The substrate 30 includes six elongated and spaced rectangular sub-plates 31, which are parallel to each other. The substrate 30 is for supporting the LED array 20 and the frame 40 thereon.

The LED array 20 includes a plurality of LED chips 21 arranged in a matrix. The LED chips 21 are mounted on a top surface of the substrate 30. The LED array 20 includes twelve lines of LED chips 21, every two of which are arranged on a corresponding sub-plate 31 along a widthwise direction (y-axis) of the substrate 30. Each line of LED chips 21 is extended along a lengthwise direction (x-axis) of the substrate 30.

The frame 40 is of reflective material having high reflectivity. In this embodiment, the frame 40 is metal such as aluminum. Alternatively, the frame 40 can be of non-reflective material with a reflecting layer coated on an outer surface thereof. The reflecting layer can be made of reflective materials such as white printing ink. The frame 40 covers the top surface of the substrate 30, and includes a plurality of first plates 41, a plurality of second plates 43 and a plurality of reflecting plates 45.

The first plates 41 are parallel to and spaced from each other. Each of the first plates 41 is elongated, strip-shaped, and extends along the x-axis of the substrate 30. The first plates 41 include three types, i.e., type-A first plate 411, type-B first plate 412 and type-C first plate 413 as shown in FIG. 2.

The type-A first plate 411 includes one in number, and is located on a middle of the substrate 30. The type-A first plate 411 includes two opposite inclined side surfaces 411*a*, which have the same slope (first slope) and face a left side and a right side of the substrate 30, respectively. Cross-section of the type-A first plate 411 is an isosceles trapezoid. The type-B first plates 412 include a plurality in number. The type-B first plates 412 are symmetrically arranged on a left side and a right side of the type-A first plate 411. Each of the type-B first plates 412 includes a first inclined side surface 412*b* which has the same first slope with the inclined side surfaces 411*a* of the type-A first plate 411, and an opposite second inclined side surface 412*a* which has a slope (second slope) smaller than the first slope of the first inclined side surface 411*b*. The first inclined side surfaces 412*b* having the first slope and located at the left side of the type-A first plate 411 face the left side of the substrate 30. The first inclined side surfaces 412*b* having the first slope and located on the right side of the type-A first plate 411 face the right side of the substrate 30. The second inclined side surfaces 412*a* having the second slope face the middle of the substrate 30. The cross-section of each of the type-B first plates 412 is substantially a trapezium. The type-C first plates 413 include two in number. The type-C first plates 413 are located at a leftmost side and a rightmost side of the substrate 30, respectively. Each of the type-C first plates 413 includes only one inclined side surface 413*a* which has the same second slope with the second inclined side surfaces 412*a* of the type-B first plates 412. The inclined side surfaces 413*a* having the second slope face the middle of the substrate 30. The cross-section of each of the type-C first plates 413 is a right trapezoid.

The second plates 43 are parallel to and spaced from each other. Each of the second plates 43 is elongated, strip-shaped, and extends along the y-axis of the substrate 30. The second plates 43 are perpendicular to the first plates 41 and interconnect with the first plates 41. The first plates 411 and the second plates 43 cooperatively form a plurality of receiving rooms 46 for receiving the LED chips 21 therein. Each of the second plates 43 includes two opposite inclined side surfaces 431 inclined with respect to the substrate 30. The inclined side surfaces 431 of the second plates 43 have the same slope (i.e., a third slope). In this embodiment, the third slope is greater than the second slope, but smaller than the first slope. Top end of each of the second plates 43 is higher than the top end of each of the first plates 41. Accordingly, each of the receiving rooms 46 is enclosed by one inclined side surface of the first slope, one inclined side surface of the second slope and two inclined side surfaces each having the third slope. Each of the receiving rooms 46 formed on the middle of the substrate 30 is enclosed by an inclined side surface 411*a* of the type-A first plate 411, a second inclined side surface 412*a* of the type-B first plate 412 and two inclined side surfaces 431 of the second plates 43; each of the receiving rooms 46 formed at the left side and the right side of the substrate 30 is enclosed by a first inclined side surface 412*b* of the type-B first plate 412, a second inclined side surface 412*a* of the type-B first plate 412 and two inclined side surface 431 of the second plates 43; and each of the receiving rooms 46 formed on the leftmost side and the rightmost side of the substrate 30 is enclosed by a first inclined side surface 412*b* of the type-B first plate 412, an inclined side surface 413*a* of the type-C first plate 413 and two inclined side surfaces 431 of the second plates 43.

Figure 3:
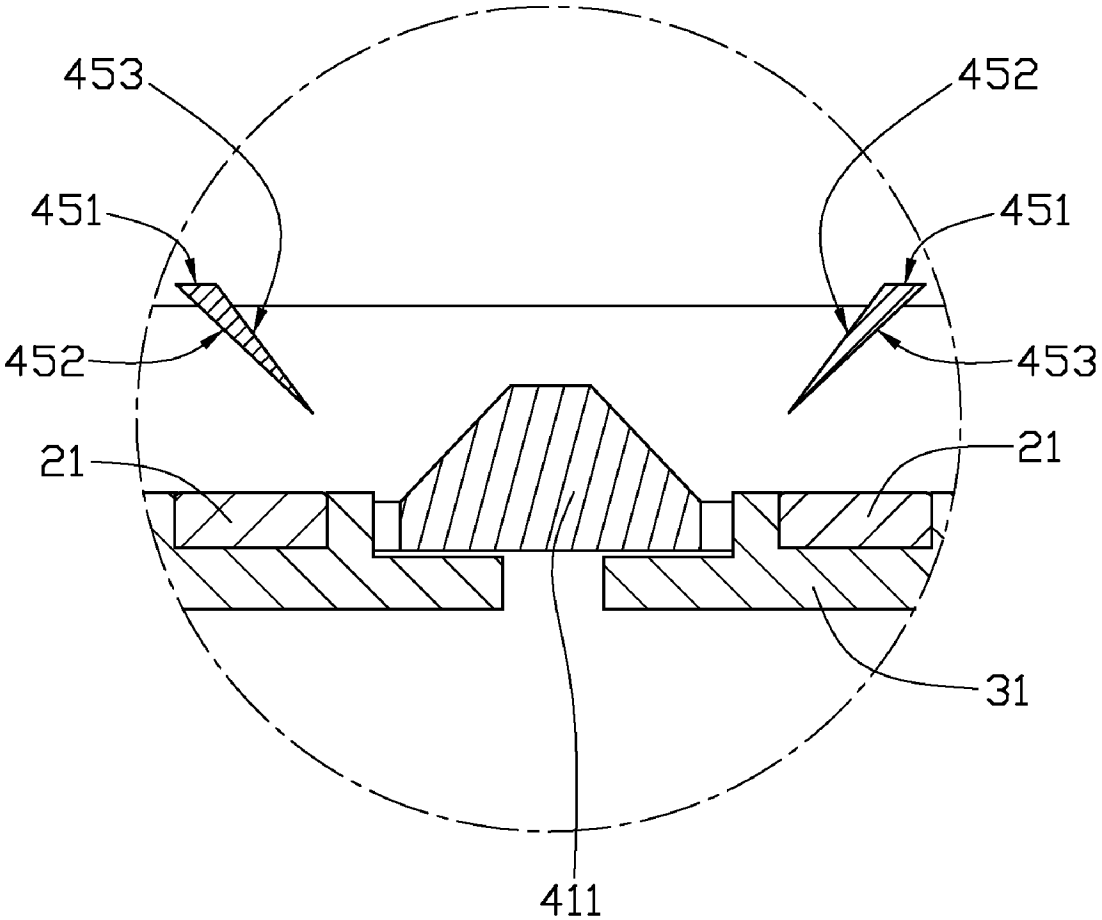
FIG. 3 is an enlarged view of a circled portion III of FIG. 2.

The reflecting plates 45 are parallel to and spaced with each other. Each of the reflecting plates 45 is elongated, strip-shaped, and extends along the x-axis of the substrate 30. The reflecting plates 45 are parallel to the first plates 41, and each of the reflecting plates 45 is located between two neighboring first plates 41. Each reflecting plate 45 interconnects with the second plates 43, and a top end of the reflecting plate 45 is higher than top ends of the second plates 43. Referring to FIG. 3, each of the reflecting plates 45 includes a top face 451 parallel to the substrate 30, and a left and a right faces 452, 453 extending downwardly and slantingly from the left side and the right side of the top face 451 respectively. The left face 452 and the right face 453 of each of the reflecting plates 45 intersect at a bottom end of the reflecting plates 45. The cross-section of each of the reflecting plate 45 is an obtuse-angled triangle.

Each reflecting plate 45 is above a respective line of LED chips 21, and inclines leftward or rightward with respect to the corresponding line of LED chips 21. The reflecting plates 45 are arranged symmetric to the middle of the substrate 30. More specifically, the reflecting plates 45, which are located at the left side of the substrate 30, incline leftward, and each of the left face 452 and the right face 453 of each of these reflecting plates 45 extends from an upper left corner towards the bottom right corner, wherein the slope of the right faces 453 is larger than the slope of the left faces 452. Comparatively, the reflecting plates 45, which are located at the right side of the substrate 30, incline rightward, and each of the left face 452 and the right face 453 of each of the these reflecting plates 45 extends from an upper right corner to the bottom left corner, wherein the slope of the right faces 453 is smaller than the slope of the left faces 452. Preferably, an angle formed between each of the left faces 452 and the right faces 453 of the reflecting plates 45 and the substrate 30 is between 20°~50°.

Figure 4:
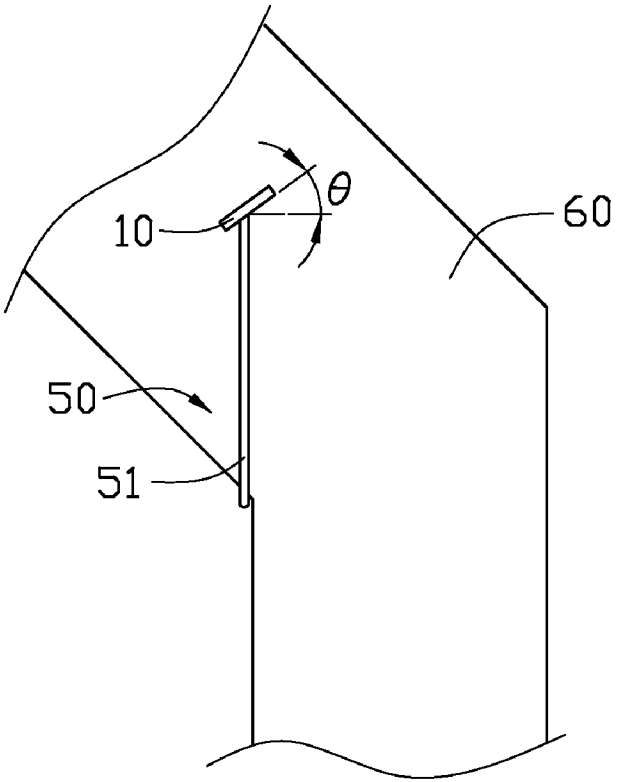
FIG. 4 is a schematic view of a street lamp incorporating the light emitting diode device of FIG. 1, according to an exemplary embodiment.

Referring to FIG. 4, a street lamp 50 incorporating the LED device 10 includes a lamp pole 51, and the LED device 10 is mounted on a top end of the lamp pole 51. The lamp pole 51 is on one side of a road surface 60, and a light emitting surface of the LED device 10 faces the road surface 60. Preferably, an elevation angle θ of 15° is formed between light emitting surface of the LED device 10 and the road surface 60. The y-axis of the substrate 30 is along with the length direction of the road surface 60, and the x-axis of the substrate 30 is along with the widthwise direction of the road surface 60.

It is well known that a radiation angle of each of the LED chips 21 is usually about 120°, which induces an outmost peripheral portion of the light emitted from the LED chips 21 to radiate towards the first plates 41 and the second plates 43 of the frame 40. Since the first plates 41 are along the x-axis direction of the substrate 30, the outmost peripheral portion of the light reflected by the first plates 41 emits towards the length direction of the road surface 60. The slope of the inclined side surfaces 412*a*, 413*a* facing the middle of the substrate 30 is smaller than the slope of the inclined side surfaces 411*a*, 412*b* facing the left or right sides of the substrate 30, thus, the light reflected by the inclined side surfaces 411*a*, 412*b* towards the left side or the right side of the substrate 30 emits farther than the light reflected by the inclined side surfaces 412*a*, 413*a* towards the middle of the substrate 30, thereby increasing the radiation angle of the LED device 10 along the length direction of the road surface 60. Since the second plates 43 are along the y-axis of the substrate 30 and higher than the first plates 41, more light is reflected by the second plates 43 towards the road surface 60 along the widthwise direction thereof, thereby increasing an intensity within the radiation angle of the LED device 60. That is, an illuminating length of the light field along the y-axis of the substrate 30 is greater than that of the light field of along the x-axis, and an illuminating intensity of the light field along the x-axis of the substrate 30 is greater than that of the light field along the y-axis, so as to improve the utilization rate of the light emitted from the LED chips 21.

Moreover, both the left faces 452 of the reflecting plates 45, which are located at the left side of the substrate 30, and the right faces 453 of the reflecting plates 45, which are located at the right side of the substrate 30, face the corresponding line of LED chips 21; thus, an internal portion of the light emitted from the LED chips 21 irradiates towards the reflecting plates 45, and is reflected by the reflecting plates 45 towards a fairly remote area of the road surface 60 along the length direction thereof. Both the right faces 453 of the reflecting plates 45, which are located at the left side of the substrate 30, and the left faces 452 of the reflecting plates 45, which are located at the right side of the substrate 30, face the inclined side surfaces 411*a*, 412*b* of the first plates 411, 412; thus, a portion of the light irradiating towards the inclined side surfaces 411*a*, 412*b* of the first plates 411, 412 can be reflected by the first plates 411, 412 and the reflecting plates 45 more than once, and accordingly the light can emit towards the road surface 60 uniformly.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light emitting diode device comprising:

a substrate;

a plurality light emitting diode chips mounted on the substrate and arranged in a plurality of lines;

a frame located on the substrate, the frame comprising a plurality of first plates each extending along a first direction of the substrate, a plurality of second plates each extending along a second direction of the substrate and a plurality of reflecting plates, the first plates and the second plates cooperatively forming a plurality of receiving rooms for receiving the light emitting diode chips therein, each reflecting plate being located above a corresponding line of light emitting diode chips and inclined with respect to the substrate.

2. The light emitting diode device of claim 1, wherein the first plates are parallel to and spaced with each other, the second plates are parallel to and spaced with each other, and the first plates intersect with the second plates to form the receiving rooms.

3. The light emitting diode device of claim 1, wherein each of the receiving rooms is enclosed by one inclined side surface of a first slope, one inclined side surface of a second slope, and two inclined side surface of a third slope, the third slope being greater than the second slope but smaller than the first slope.

4. The light emitting diode device of claim 1, wherein a top end of each of the second plates is higher than top ends of the first plates.

5. The light emitting diode device of claim 1, wherein each of the reflecting plates interconnects with the second plates, and a top end of the reflecting plate is higher than top ends of the second plates.

6. The light emitting diode device of claim 1, wherein each of the first plates extends along a lengthwise direction of the substrate, each of the second plates extends along a widthwise direction of the substrate, and each of the reflecting plates extends along the lengthwise direction of the substrate and interconnects with the second plates.

7. The light emitting diode device of claim 1, wherein the reflecting plates are arranged symmetric to a middle of the substrate, the reflecting plates which are located at a left side of the substrate inclined leftward, the reflecting plates which are located at a right side of the substrate inclined rightward.

8. The light emitting diode device of claim 7, wherein an angle formed between the each of the reflecting plates and the substrate is between 20°~50°.

9. The light emitting diode device of claim 7, wherein each of the reflecting plates comprises a top face parallel to the substrate and two inclined side faces inclined with respect to the substrate, the inclined side faces extending downwardly from a left and a right sides of the top face respectively and intersecting at a bottom end of the reflecting plate.

10. The light emitting diode device of claim 9, wherein a cross section of each of the reflecting plates is an obtuse-angled triangle.

11. The light emitting diode device of claim 1, wherein each of the first plates comprises at least one inclined side surface inclined with respect to the substrate.

12. The light emitting diode device of claim 11, wherein some of the first plates each comprises a first inclined side surface facing the corresponding line of light emitting diode chips and an opposite second inclined side surface, a slope of the first inclined side surface being smaller than the slope of the second inclined side surface.

13. The light emitting diode device of claim 12, wherein a cross-section of each of the first plates is substantially a trapezium.

14. The light emitting diode device of claim 11, wherein one of the first plates is located at a middle of the substrate, the middle first plate comprising two opposite inclined side surfaces which have the same slope.

15. The light emitting diode device of claim 14, wherein a cross-section of the middle first plate is an isosceles trapezoid.

* * * * *